US005169095A

United States Patent [19]

Lecat

[11] Patent Number: 5,169,095

[45] Date of Patent: Dec. 8, 1992

[54] SELF-RIGHTING GLIDING AEROBODY/DECOY

[75] Inventor: Robert J. Lecat, Centerport, N.Y.

[73] Assignee: Grumman Aerospace Corporation, Bethpage, N.Y.

[21] Appl. No.: 656,007

[22] Filed: Feb. 15, 1991

[51] Int. Cl.[5] ..... F42B 10/14

[52] U.S. Cl. ..... 244/3.28; 244/3.3

[58] Field of Search ..... 244/3.27, 3.28, 3.29, 244/3.3, 1 TD, 113, 110 D, 49; 273/360, 361

[56] References Cited

U.S. PATENT DOCUMENTS

| | | | |
|---|---|---|---|
| 3,744,741 | 7/1973 | Christian et al. | 244/49 |
| 4,008,667 | 2/1977 | Look | 244/3.28 |
| 4,135,686 | 1/1979 | Herpfer | 244/3.27 |
| 4,165,847 | 8/1979 | Detalle | 244/3.29 |
| 4,209,146 | 6/1980 | Mattson | 244/3.27 |
| 4,209,147 | 6/1980 | Jones, Jr. | 244/3.28 |
| 4,440,360 | 4/1984 | Hallstrom | 244/3.28 |
| 4,583,703 | 4/1986 | Kline | 244/3.27 |
| 5,029,773 | 7/1991 | Lecat | 244/3.28 |
| 5,048,773 | 9/1991 | Washington et al. | 244/3.28 |

FOREIGN PATENT DOCUMENTS

| | | | |
|---|---|---|---|
| 2613453 | 10/1977 | Fed. Rep. of Germany | 244/1 TD |

*Primary Examiner*—Michael J. Carone

*Attorney, Agent, or Firm*—Pollock, VandeSande & Priddy

[57] ABSTRACT

The effectiveness of randomly indexed randomly ejected decoys/aerobodies is improved by flying lifting glide instead of ballistic trajectories. Elements matching body contours are deployed to locate the neutral point above and behind the center of gravity. These elements are oriented to generate strongly cross-coupled forces and moments in pitch and yaw, provide favorable aerodynamic rolling moments and trim the configuration at positive lift. Various layouts are discussed. Means of achieving desirable stability levels, even at supersonic speeds, improve trimmed lift/drag ratios, minimize induced roll and inertial cross-couplings, etc., are also described.

9 Claims, 10 Drawing Sheets

SELF-RIGHTING GLIDING AEROBODY/DECOY

RELATED PATENT APPLICATION

The present invention is related to my co-pending patent application Ser. No. 07/469,123, filed Jan. 24, 1990 now U.S. Pat. No. 5,029,773.

FIELD OF THE INVENTION

The present invention relates to aerobodies, and more particularly to air-launched bodies or decoys randomly indexed and launched in random directions. The invention stabilizes such bodies in an upright position to fly lifting glide trajectories rather than the usual non-lifting, quasi-ballistic trajectories.

BACKGROUND OF THE INVENTION

Decoys launched from aircraft and airborne machines can typically be loaded in any one of many cells or canisters in a rack which can be loaded in various locations (top, bottom, sides, rear) of different aircraft or even the same aircraft. The decoys are usually stowed in the storage canister without any specific indexing.

When ejected, the body/decoy must be stable, line up with the free stream and fly predictable trajectories. These trajectories should ideally approximate the flight path of the launching aircraft and allow the decoy to radiate/receive in some desired sectors, usually rear and/or front and particularly in the rear sector, below the horizontal.

Most decoys follow unpowered quasi-ballistic trajectories at essentially zero lift. Then, they quickly sink away from the aircraft path with increasing vertical velocities which facilitate discrimination. Further, the attitude of a stable non-lifting body closely matches the increasingly steep slopes of the ballistic trajectory. Then, the center line of an antenna beam is tilted upwards towards the vertical, reducing its effectiveness. Practical effectiveness is often terminated when the lower edge of the beam reaches the horizontal.

All these factors, and many other important ones, e.g. vertical and longitudinal separation from the launching aircraft, etc., are directly related to the trajectories. Obvious improvements can be achieved with lifting glide trajectories.

In the steady glide, vertical sink velocities and glide path angles become quasi-constant. Both the flatter glide path and the positive angle of attack of the body improve the downward orientation of the rear beam. At high dynamic pressures, when lift exceeds weight, the decoy can even climb initially, further increasing its useful lifetime.

This is illustrated in FIG. la which shows three trajectories of the same configuration trimmed at different conditions:

- trajectory 1, trimmed at $\alpha = O_1$ zero lift, ballistic trajectory
- trajectory 2, trimmed at $\alpha \simeq 6°-8°$ intermediate lift/drag $\approx 1$
- trajectory 3, trimmed at $\alpha \approx 20°$ maximum lift/drag ratio $\simeq 2$ Equally spaced time intervals $T_1$, $T_2$, $T_3$, $T_4$, etc., identify decoy positions at comparable times along each trajectory.

Assuming 90° beam angles, as sketched, the effectiveness of the decoy along trajectory 1 is nearly lost at time $T_2$. The flight path angle is close to 45° and the rear beam is essentially above the horizontal.

Trajectory 2 climbs above the initial altitude $h_o$ and still shows some effectiveness at time $T_4$. Trajectory 3 is effective throughout and beyond $T_6$ into the stable glide portion of the trajectory.

As shown in FIG. 1*b*, a given decoy configuration launched at either high or low dynamic pressures will eventually stabilize in equilibrium glide at very similar values of flight path angle, body angle of attack, and beam orientation. Effectiveness can be maintained over a wide range of operating conditions.

Increasing the lift-to-drag ratio flattens the flight path. Flying at substantial lift-to-drag ratios also means substantial levels of body angle of attack, particularly when dealing with aerodynamically unrefined decoy bodies with relatively large drags at zero lift. Then, the beam center lines can remain essentially horizontal, not only in glide, but even throughout the trajectory.

High levels of effectiveness can be maintained over a wide range of dynamic pressure until either vertical separation (minimized by the lift forces) or longitudinal separation or some combination of parameters reduces effectiveness below desired levels.

The advantages of lifting trajectories are evident, but they assume not only lift but indexing of the lift forces upwards, against gravity. Achieving this desired orientation with a randomly indexed body ejected in random orientations becomes a major goal of the invention.

BRIEF DESCRIPTION OF THE PRESENT INVENTION

Several requirements must be met to stabilize a flying body on a steady lifting glide trajectory after ejection in a random direction which may be quasi-normal to the airstream, inducing very large angles of attack.

The body must, in some order or even concurrently:

- line up in the free stream direction
- roll to the desired attitude
- stabilize at the desired angle of attack with null moments about all three axes.

To line up with the free stream, the body must be stable in both pitch and yaw. The neutral point of the configuration and the location of the combined aerodynamic forces must be behind the center of gravity, i.e. farther aft from the nose than the center of gravity.

When ejected broadside at 90° angle of attack, the centroid of area of the projected planform should be further aft from the nose than the center of gravity. If the configuration is longitudinally asymmetrical and composed of elements with different orientations to the free stream (empennages) or different cross flow drag coefficients (body, empennages), the effective resultant of the aerodynamic forces should again be further aft from the nose than the center of gravity. It is very desirable but not absolutely necessary that this be satisfied for any body orientation when the body is rotated through 360° with its center line normal to the free stream.

To index the roll attitude to gravity and get "pendulum stability," the neutral point of the configuration should generally be above the center of gravity. With the body aerodynamic center near the body center line, close to the nose, the aerodynamic center of the deployed empennages must be located well above the configuration center line to locate the resultant neutral point above the body center of gravity, as shown in FIG. 2*a*. The empennages must be deployed in the upper rear quadrant; configuration asymmetry in the vertical plane results.

To stabilize at the desired angle of attack the empennage setting must reduce configuration pitching moments to zero at the desired angle of attack. To get null moments in roll and yaw, lateral symmetry is required, at least in the aerodynamic sense, if not in the strictly geometrical sense. But all these are not necessarily sufficient

- The "pendulum" rolling moments are very small, a few pound inches at most. In steady flight, they must be augmented by much larger stabilizing aerodynamic rolling and damping moments.
- The aerodynamic rolling moments may be much larger than the "pendulum" rolling moments at some dynamic pressure level. Over the range of conditions and throughout the roll, the sum of the "pendulum" and aerodynamic rolling moments must remain favorable.
- To avoid tumbling the empennages must also maintain adequate levels of pitch and yaw stability over a wide range of angles of attack.

Thus, the empennages must provide adequate aerodynamic stabilizing moments about all three axes throughout the transition maneuver from ejection to steady flight at the desired roll orientation.

To provide stabilizing aerodynamic pitching and yawing moments, symmetrical empennages generating body pitch and yaw components are desirable, to maintain their effectiveness through the roll maneuver.

If they also provide a positive dihedral effect, like a "vee" or "butterfly" tail, shown in FIG. 2*b*, aerodynamic stabilizing contributions about all three axes can be generated.

With the usually symmetrical bodies, stability requirements in pitch and yaw are similar, resulting in large dihedral angles (40° to 50°). As illustrated in FIG. 2*c*, the large dihedral on planar surfaces gives resultant aerodynamic forces which will act well above the roll axis of inertia. Induced roll and inertial cross couplings result and could significantly complicate the violent dynamic transition from ejection to stabilized flight.

However, as shown in FIG. 2*d*, stabilizer planforms matching cylindrical body contours can also be deployed symmetrically. They orient the resultant aerodynamic forces downward toward the axis of inertia (rather than upwards with the planar "vee" empennage) and reduce the cross couplings to small or negligible levels.

Thus, layouts of configurations according to the invention feature:

- Vertically asymmetrical configurations, with the empennages deployed in the upper rear quadrant, to locate the neutral point above as well as behind the center of gravity.
- A laterally symmetrical empennage layout. Each side provides both pitch and yaw forces and moments as well as a positive dihedral effect stabilizing the configuration about all three axes.
- To minimize inertial cross couplings, the orientation of the resultant aerodynamic force on each empennage should preferably be aimed toward the roll axis of inertia.

Practical configuration layouts must not only satisfy the design guidelines outlined above but also be physically and mechanically compatible with numerous combinations of design constraints and operational requirements which cannot be completely anticipated or discussed.

To illustrate representative applications of the invention, several examples based for simplicity on a generic body shape will be described and their merits and shortcomings discussed.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 3A:
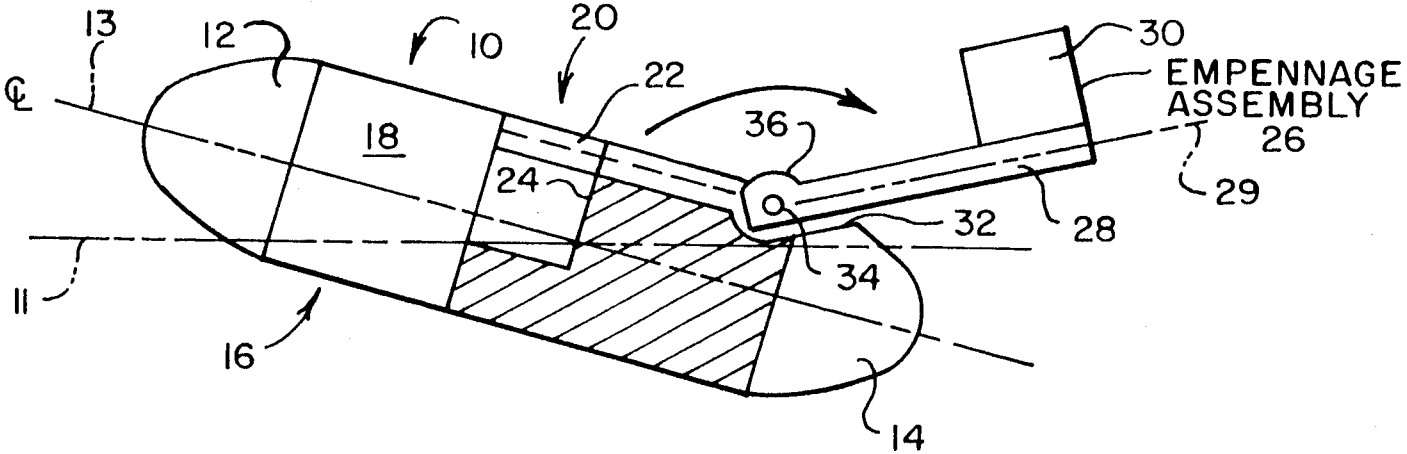
FIG. 3*a* is a diagrammatic view of an embodiment of the present invention utilizing a deployable empennage assembly.

Referring to FIG. 3*a*, the decoy body geometry is simplified to a cylindrical body 18, housing the electronics, streamlined at either end by bullet-shaped fairings or radomes 12, 14 housing an antenna (not shown). The decoy 10 is stored without special indexing in a cylindrical (or suitably polygonal) canister closely matching body contours which may be randomly oriented (up, down, sidewise, aft). The decoy 10 may be ejected by means of springs, pyrotechnics, and other devices.

Figure 3B:
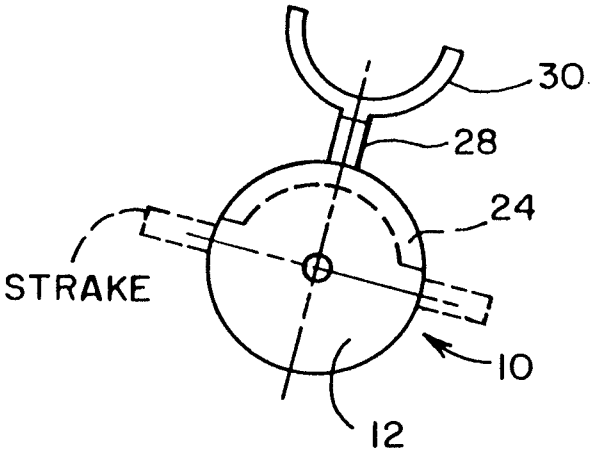
FIG. 3*b* is a front view of the body shown in FIG. 3*a*.

In the form of the invention illustrated in FIGS. 3*a* and 3*b*, the body 18 includes an internal cut-out indicated by the reference numeral 20 to accommodate a pivoting arm 28 and the empennage 30 which comprise the empennage assembly 26 when the latter is in stored position. The internal cut-out 20 includes a longitudinal cut-out 22, matching the arm 28 and a semicylindrical relief 24 matching the similarly configured empennage 30.

When the decoy is stored, the empennage assembly 26, comprised of the rotating arm 28 and empennage 30, rests within the shallow internal cut-out 20 so that it fits within the canister contours flush or quasi-flush with the surface of the decoy body.

When the decoy is ejected, aerodynamic and, if needed, spring forces acting on the empennage assembly 26 will cause the empennage 30 to rotate through a preset obtuse angle, about the inward end 36 of the empennage arm 28, pivotally mounted at the upper rear of the body 34. The angular rotation of the empennage arm 28 is limited by a mechanical stop 32 which may include damping material. Alternatively, a restraining extensible member may be preferred particularly for long empennage arms also incorporating shock-absorbing materials or dampers.

When the empennage is deployed, usually within fractions of a second, the semicircular empennage will provide the desired stability margins in pitch and yaw with the empennage area and effective lift curve slope determining the empennage characteristics. The length of the arm 28 may be increased if necessary by telescopic extension to increase the empennage stability contributions and the resulting configuration stability levels.

When the pitching moment contributions of the deployed empennage 26 null out the sum of the pitching moments about the center of gravity, the decoy configuration stabilizes in flight attitude. Parametric variations of the empennage size and contours, arm length, and deployment angle usually identify a combination which will trim the decoy (zero moments, stable slopes) at the desired angle of attack and corresponding lift/drag ratio. If necessary, the empennage setting with respect to the arm 28, zero in this example, could be offset by various means, changing the effective incidence of the empennages, configuration trim angle of attack and lift/drag ratio.

With this very simple configuration layout, roll stability and damping are relatively low. With the empennage directly behind the body, interferences can become a problem at transonic speeds even when avoided at subsonic speeds.

Figure 4B:
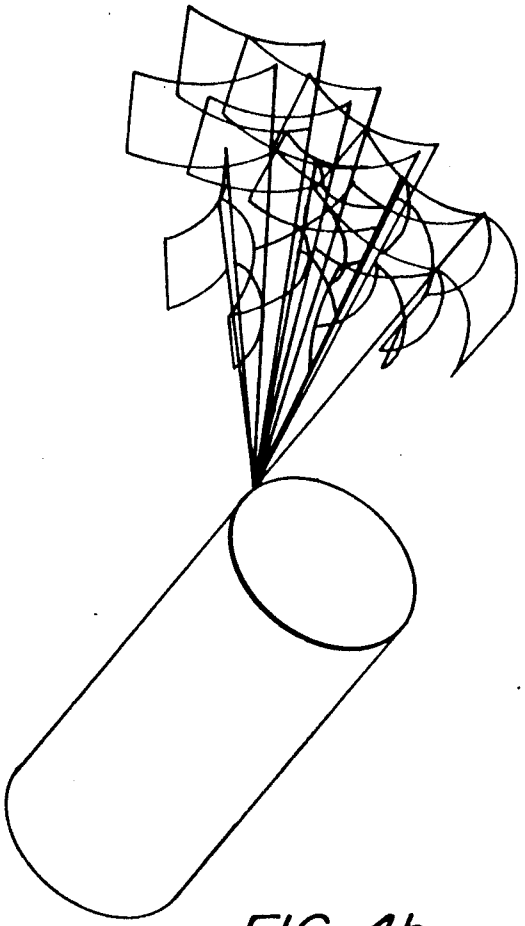
FIG. 4*b* is a diagrammatic view illustrating a deployed empennage rotated about a skewed hinge axis at a variable hinge line skew angles.
Figure 4A:
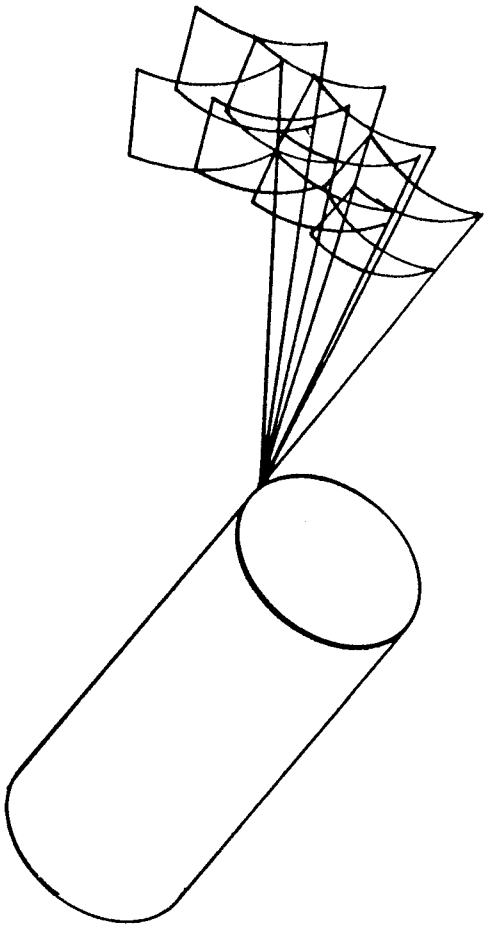
FIG. 4*a* is a diagrammatic view illustrating a deployed empennage rotated about a skewed hinge axis at a given hinge line skew angle.

In another form of the invention, illustrated in FIGS. 4*a* and 4*b*, the configuration features empennages deployed by arms which rotate about skewed hinge axes at the rear of the body.

For simplicity, only one of the symmetrically deployed empennages is illustrated. The arms are indexed to the edge of the empennage rather than near the middle and the empennages are simplified to 90° segments of the skin of a body of revolution, again for simplicity and clarity. The arms are also drawn straight but might be kinked or curved to clear various sections of the body pre-empted by other requirements, e.g. side antenna, heat dissipation surfaces, etc.

The effects of deployment angle at a given hinge line skew angle are shown in FIG. 4*a*. FIG. 4*b* illustrates the effects of deployment angle at two different hinge line skew angles, to illustrate the wide range of available options in empennage orientation and location. Pivot point location and arm length, two other useful parameters remained fixed in these examples and could, of course, be also varied.

Figure 4C:
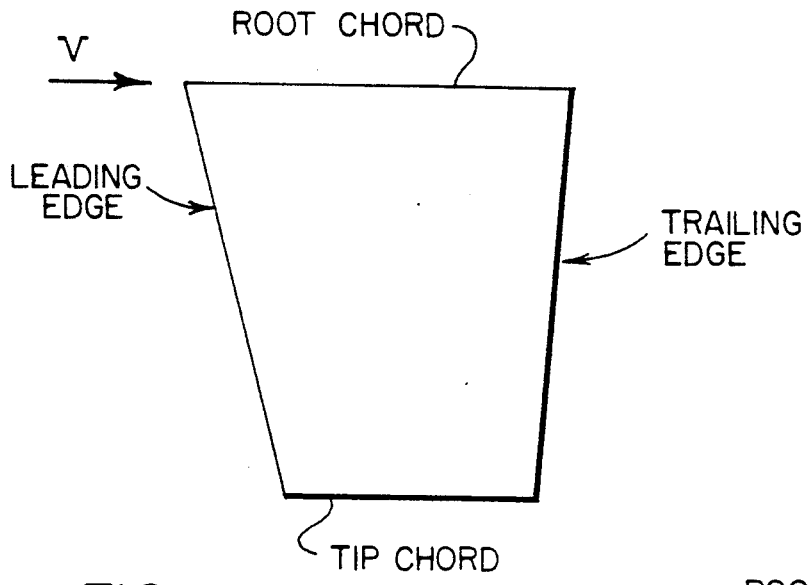
FIG. 4*c* is a side view of an empennage planform characterized by a sweep angle.
Figure 4D:
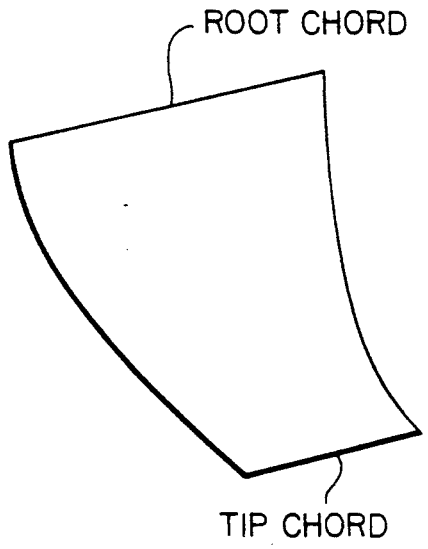
FIG. 4*d* is a perspective view of an empennage planform characterized by a sweep angle.

The empennage planform can also be tailored in sweep, aspect ratio and aerodynamic center location, varying the size and location of the tip chord, as illustrated in FIGS. 4*c* and 4*d*.

Variations in sector angle, assumed 90 ° for simplicity can also be made, with corresponding consequences in aerodynamic characteristics. However, near maximum empennage arc sector angle is usually desirable, considering the rather similar stability requirements in yaw as well as pitch. Also, sector angles exceeding 90° become increasingly hard to justify or implement, unless empty space around the front radome below the ejection sabot can be profitably used.

Aerodynamic rolling moments are controlled by the relative values between the sides (L.H & R.H.) of the symmetrical configuration of the aerodynamic lift and/or cross flow drag, depending on the angle of attack range.

At $\alpha \simeq 90°$ it is usually desirable to feature larger cross flow drag drag coefficients in the inverted flight attitude ($\phi \simeq 180°$) than in the upright attitude ($\phi = 0$).

Lateral separation of the aerodynamic centers of the empennages is also a key parameter. Increasing it obviously increases the stiffness of the restoring aerodynamic moments near the equilibrium roll attitude ($\phi = 0°$) More importantly, the aerodynamic damping (roughly a function of the square of this distance) is also increased. This minimizes maximum roll rates (and inertial cross couplings) and also, the roll overshoots in dynamic maneuvers. Roll overshoots of $\simeq 90°$ at some combinations of roll rate, pitch, and yaw angles and angular rates can result in transiently adverse aerodynamic rolling moments. Then, the roll maneuver is not critically damped, it may take several roll revolutions to achieve equilibrium or even tumble.

The increased lateral separation of the empennages has several beneficial consequences.

It increases roll stability and aerodynamic damping.

It minimizes or eliminates:

body interference with the empennages, empennage interferences with the rear antenna beam, induced aerodynamic rolling moments when the resultant aerodynamic forces on the arcuate surface generate not only the desired moments (and their slopes) but are also aimed inboard and down, towards the roll axis of inertia.

On most decoy configurations, stability levels decrease at supersonic speed. When speed increases the lift curve slope of the very large body will vary much less with mach number than the lift curve slopes of empennages which decrease much more with increasing mach number due to their relatively higher aspect ratios. The desired stability levels become increasingly hard to achieve within the available constraints on empennage area, arm length and other design limits.

Then, in another form of the invention, the empennages are deployed with their chords broadside to the stream like paddles to generate "impact" forces rather than being deployed quasi-streamwise to generate "lift" forces in the previous examples. These "impact" forces increase as shock strength and mach number increase; opening possibilities of constant or even increasing stability levels as mach number increases.

Figure 5A:
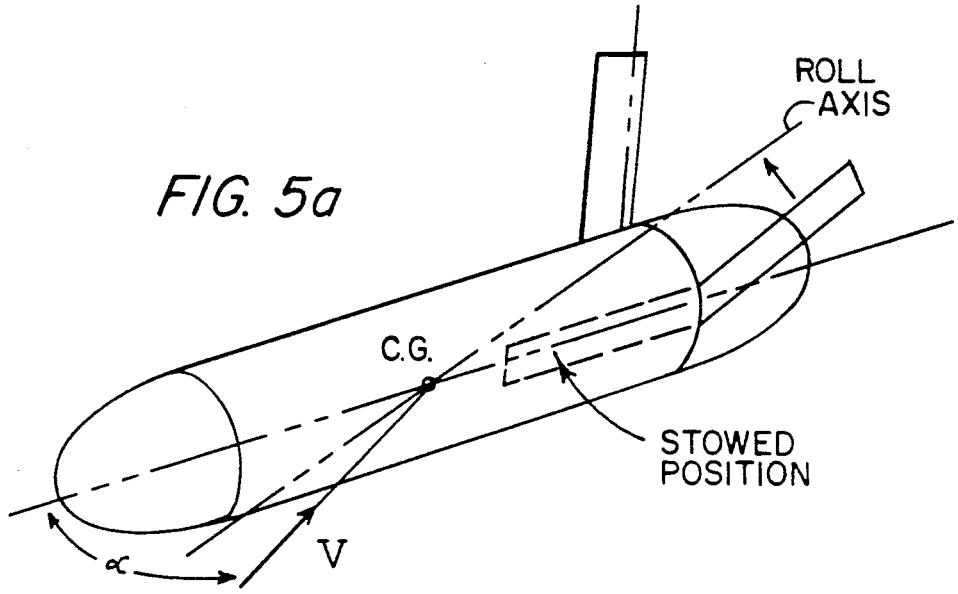
FIG. 5*a* is a diagrammatic view of a body equipped with deployable empennages which rotate to deployed positions by rotation about skewed hinge axes.

The concepts and design of these empennages are very similar to those disclosed in the previously identified related patent application on towed bodies and decoys. Briefly, to increase shock strength and approach near maximum two-dimensional values, the empennage planform should also be as two-dimensional as possible: long length, narrow chord. These empennages could be made of narrow strips matching body contours over substantial body length and deployed by rotation about skewed hinge axes as illustrated in FIG. 5*a*.

When deployed, these naturally concave cross sections can give near maximum detached shock values. However, instabilities in the subsonic flow pocket can also occur. Then, convex cross sections which are also more amenable to parametric studies become desirable. As described in the related patent application, this can be mechanically achieved by a hinge connection along the empennage center line or aeroelastic deformation under load of empennage blades made of elastic material, supported by a stiff stem along the center line.

Figure 5B:
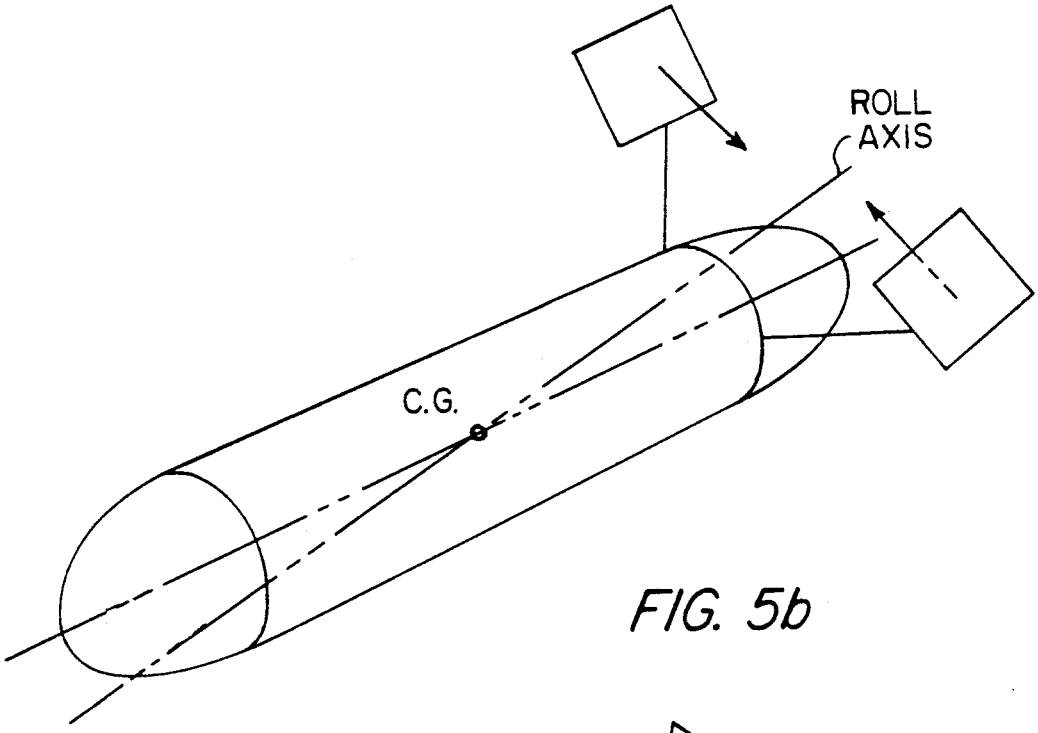
FIG. 5*b* is a schematic illustration of a body equipped with empennage paddles angularly offset from the body by thin deployment arms.
Figure 5C:
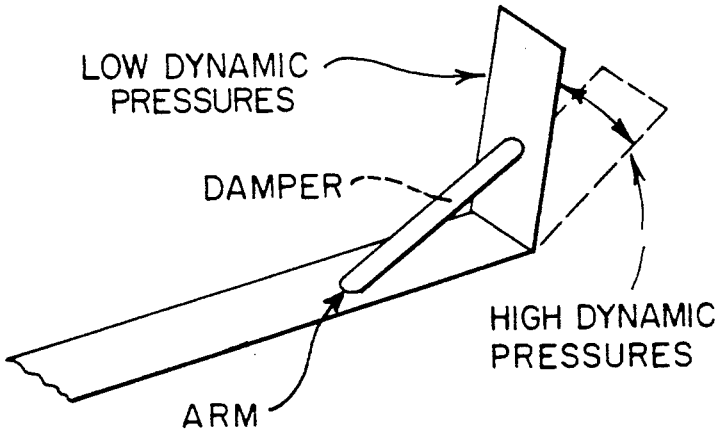
FIG. 5*c* is a schematic detail view of a deployment arm, wherein the empennage paddle may assume a variable setting.

To decrease empennage negative lift contributions and still achieve the desired moment levels, it can be advantageous to delete the inboard (close to the fuselage) empennage section, replacing it with a slim deployment arm as shown in FIG. 5*b*. The trade offs involve leaving empennage paddles of sufficient high aspect ratio to achieve, at trim conditions, maximum pitching moments for minimum negative lift.

In some special cases it may be desirable to also vary the empennage setting with respect to the deployment arm. Reducing this setting reduces empennage moments, configuration angle of attack and usually configuration lift/drag ratio. Very large reductions in drag levels also result which may be used to improve the decoy trajectories and usefulness, e.g. longitudinal separation at high dynamic pressures. At dynamic pressure levels corresponding to equilibrium glide design values, the empennage setting can remain set within narrow limits to give the desired angle of attack lift/drag ratio and antenna beam orientation at nominal design values.

This is readily implemented with an additional hinge (skewed if advantageous) connecting the empennage paddle to the deployment arm. The empennage setting with respect to the arm is controlled by an elastic restraint (e.g. a spring-loaded stem) which stretches under increased loads, decreasing empennage setting as in the related patent application.

Finally, considering the advantages of pronouncedly convex cross section of carefully defined geometry, it may be advantageous and mechanically much simpler to store these empennages around the nose radome. Space is limited but the large moments of inertia of their cross section makes them good column supports allowing them to support the rather large ejection loads (10 to 20 g's) which would otherwise "crush" the nose radome. Then, a much smaller sabot, resting directly on the empennages could provide both the desired packaging space and elimination of critical loads on the nose radome.

In all previous discussions, it could generally be assumed that the empennage forces contributed a negative lift to generate the nose-up moments needed to trim the body as a positive angle of attack. With the relatively low lift levels of the usually circular cross section bodies, negative empennage lifts represent significant losses in configuration lift/drag ratio.

Increasing body lift and/or reducing the pitching moments required for trim are obviously desirable. Changes in body cross section, e.g. a square body cross section would increase body lift and would also be very valuable packaging volume with improved packing factors.

Alternatively, strakes hinged along a generatrix of a cylindrical body parallel to the body center line located in the vicinity of the body maximum width could also be deployed as shown in FIG. 3*b*. The span/separation of the body vortices can now be greater than the geometric span of the strake-body combination instead of smaller with a circular body cross section. This generates significant amounts of additional "vortex lift."

Furthermore, the body center of pressure can then be moved aft, close to the center of gravity, reducing body unstable nose-up pitching moments and alleviating the constraints (size, arm length) on empennages sized to the desired stability levels.

But none of these features eliminates the empennage negative lift contribution required to achieve a positive angle of attack and positive lift.

To trim at a stable configuration at a positive angle of attack and positive lift, a nose-up moment at zero lift is required. Two approaches are available to increase nose-up pitching moments.

Negative camber, i.e. cambering of the body (noseup), which with a straight body means asymmetrical antenna radomes. Aerodynamic benefits are at best limited when traded off against electronic performance and their punctilious requirements affected by these distortions.

Figure 6:
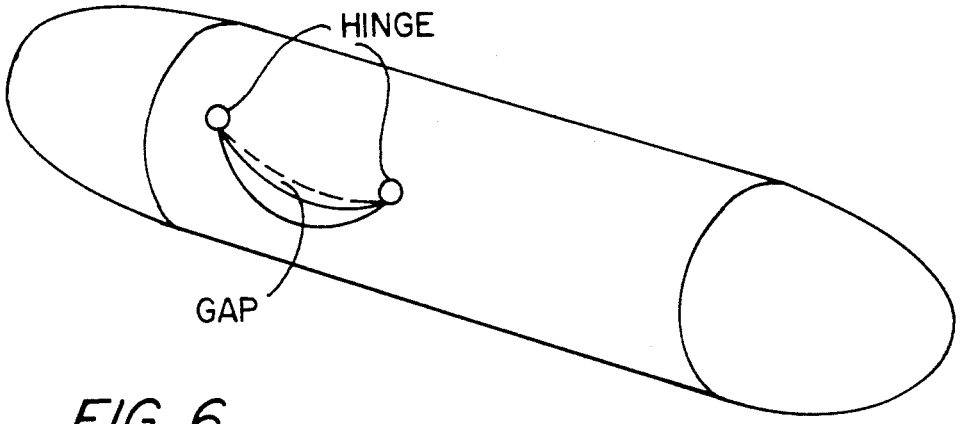
FIG. 6 is a diagrammatic illustration of a body having a hinge mounted control surface which may be deployed from a body-hugging position.

The other approach requires a basically stable configuration with forward surfaces at a positive incidence to generate a positive nose-up moment when the configuration is at zero lift. Deployment of such a surface outside of the prohibited radome beam areas on a cylindrical body, at some incidence angle with respect to the body center line is a problem. The arcuate contours are not compatible with linear hinges. Such surfaces could still be deployed about two hinge points but this leaves an open gap between the deployed surface and body contours, as shown in FIG. 6, reducing its effectiveness.

Continuous linear hinges conceptually require a flat area of desirable length and also adequate width to be compatible with the incidence angles of the hinges. Using a single break in the hinge lines for simplicity, the apex (hinge line leading edge), hinge line trailing edge, and the break point define a plane, cutting the body surface. To minimize lost body volume, always at a premium, this plane should preferably be as far outboard as possible to minimize lost volume and maximize the span of the deployed surfaces. The break point on the flat side is shown to the right of the figure, while an offset break point is shown on the left, illustrated in FIG. 7*a* using a hexagon for simplicity and generality.

Note that a regular hexagon eliminates the wasted space between the usual design of the stacked cylinders, increasing volume available for the stowed decoys which is always desirable.

Since the deployed surfaces rotate normal to the hinge line, planform elements normal to the hinge line would leave a gap between the front and rear stowed surfaces, which will naturally narrow as the surfaces rotate upwards. Then, depending upon the deployment rotation angle, the trailing edge of the front surface and the leading edge of the rear surface can be contoured to eliminate any gap between the two surfaces when they are deployed, as sketched in FIG. 7*b*.

The deployed surfaces could, of course, extend from the hinge line to the bottom center line, increasing the area and particularly the span of the deployed surfaces.

Figure 7A:
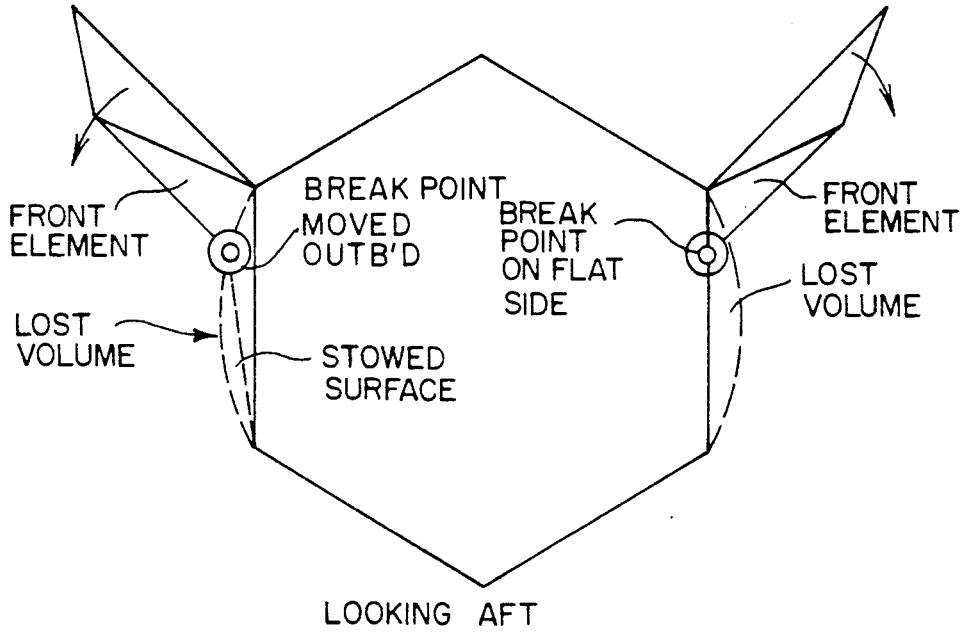
FIG. 7*a* is a rear view of the body equipped with rotatable planform surfaces which are normally stored against flattened surface sections in a generally cylindrical body.
Figure 7B:
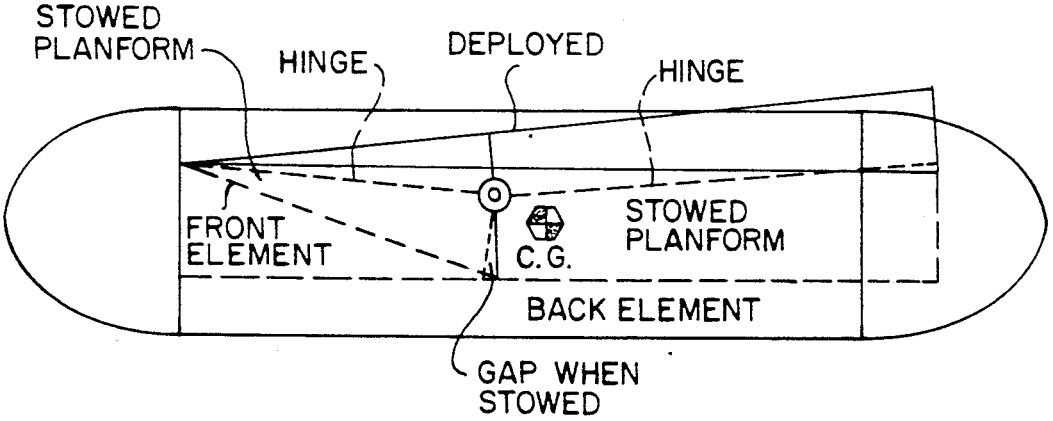
FIG. 7*b* is a diagrammatic side view of the structure diagrammatically illustrated in FIG. 7*a*.

The surfaces could be extended aft, when stowed around the rear radome, up to tolerable interferences with the rear beam when deployed, as shown in FIG. 7*b*. Note that the interferences are only in the upper rear sector, usually less critical than those in the bottom quadrants.

Figure 7C:
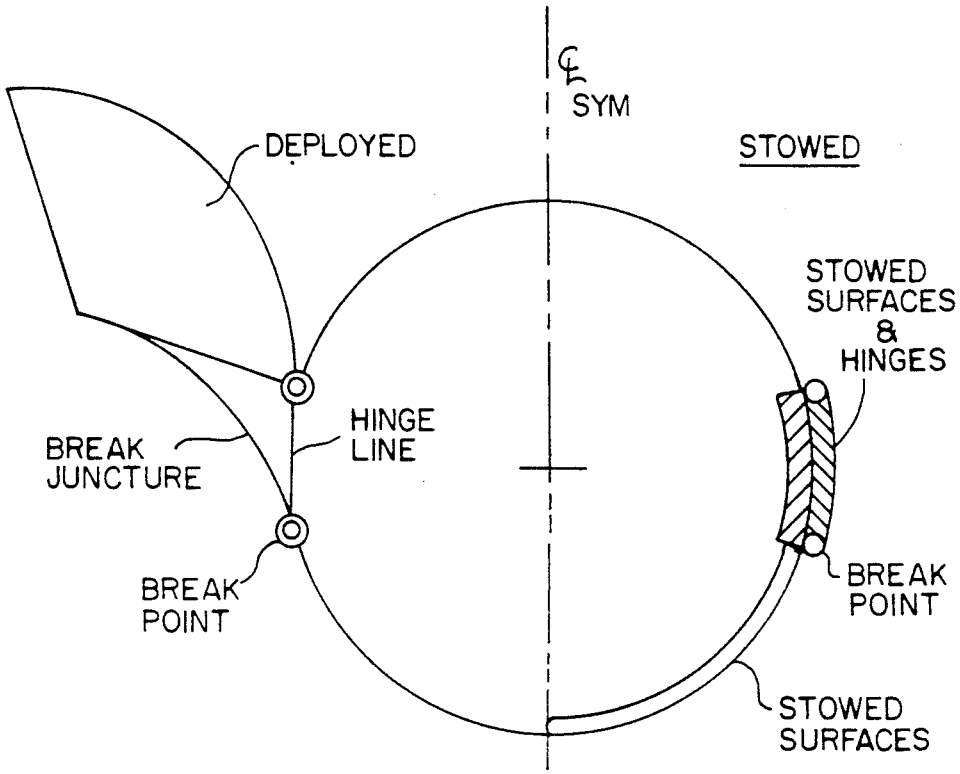
FIGS. 7*c* and 7*d* are diagrammatic views of a cylindrical body having a rotatable planform hingedly mounted on a cylindrical body without flat surface portions.

This scheme is also applicable to circular bodies, as illustrated in FIG. 7*c*. Note that the lost body volume is very little more than that due to the thickness of the deployed surfaces, particularly when the break point is very close to maximum body width. The apex of the hinge lines and trailing edge need not be located at the same height above the break point. The trailing edge point can be raised to increase the span of the deployed trailing edge and increase aerodynamic stability levels.

Estimating the aerodynamic characteristics of arcuate wings, particularly in the presence of a very large body is difficult. Some data are available on delta planforms (Rogallo wings) and even cylindrical quadrants and sectors, but none were found on non-delta or non-rectangular planforms or cambered sections or coupled with bodies of substantial wing span diameter. Very little data are available at high angles of attack, when vortex lift contributions are very significant on low aspect ratio configurations.

Figure 1A:
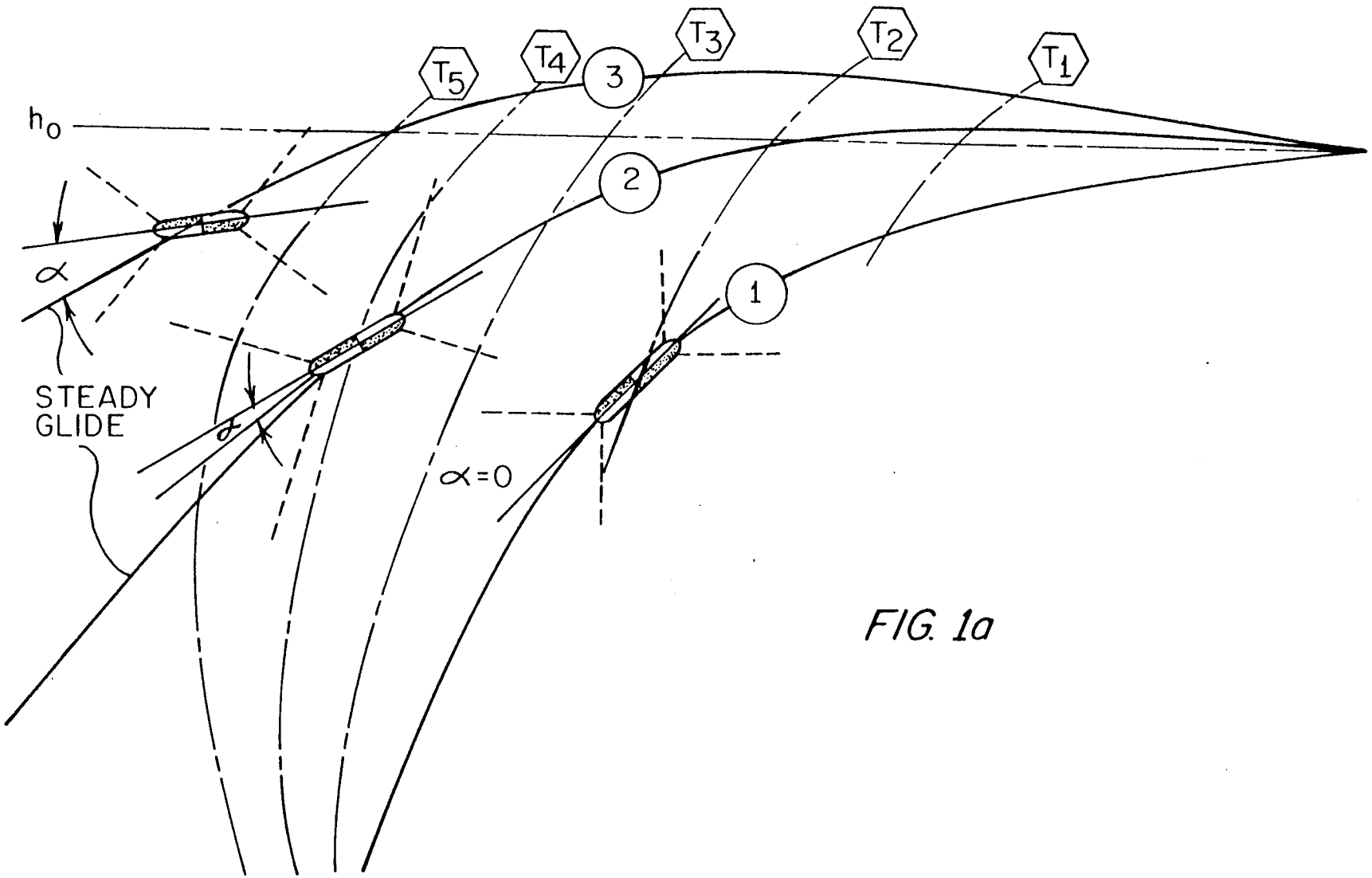
FIG. 1*a* is a plot of the effect of lift-drag on trajectories and decoy attitude.
Figure 1B:
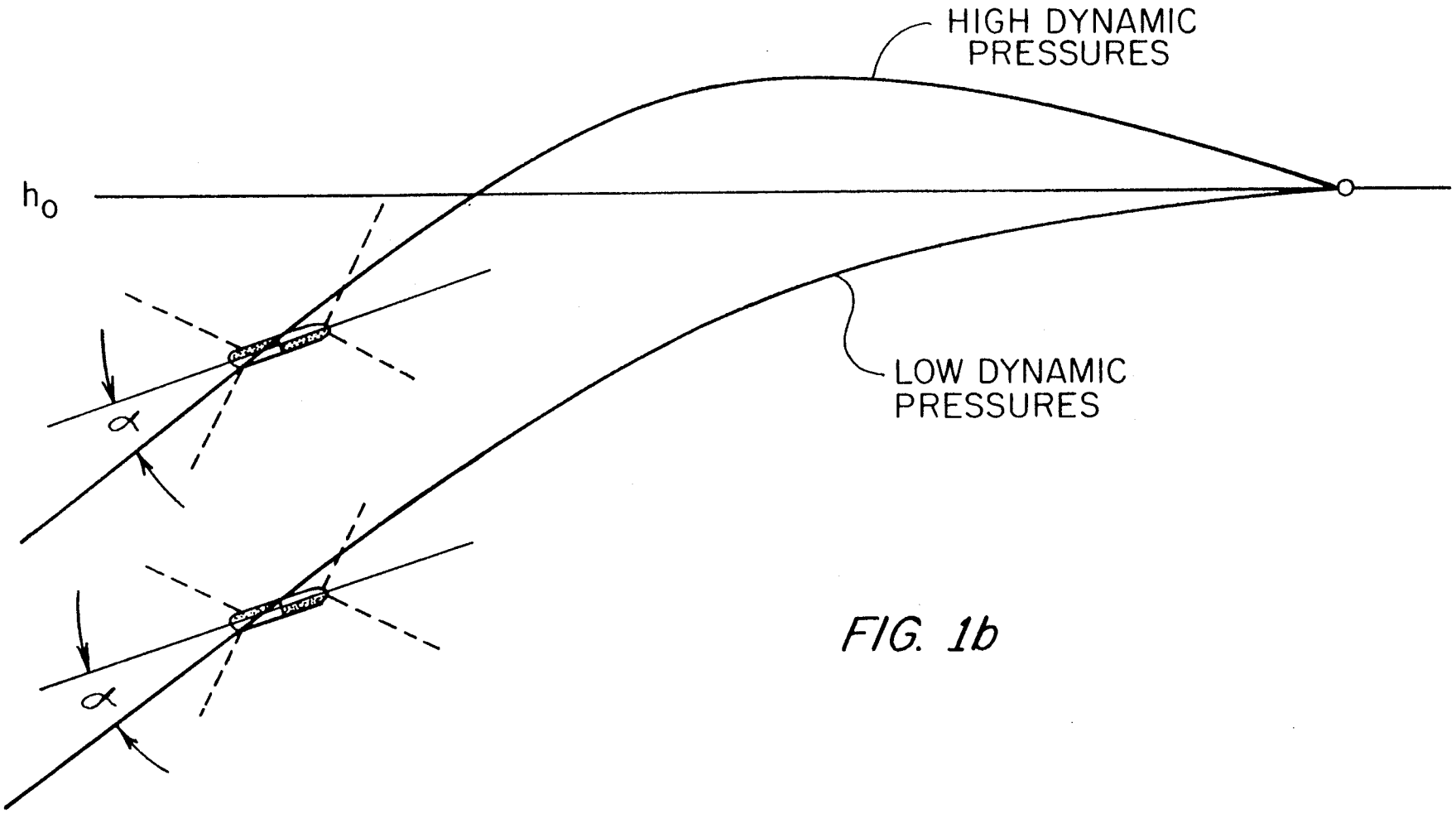
FIG. 1*b* is a plot of the effect of dynamic pressure on trajectories and decoy attitude.
Figure 2A:
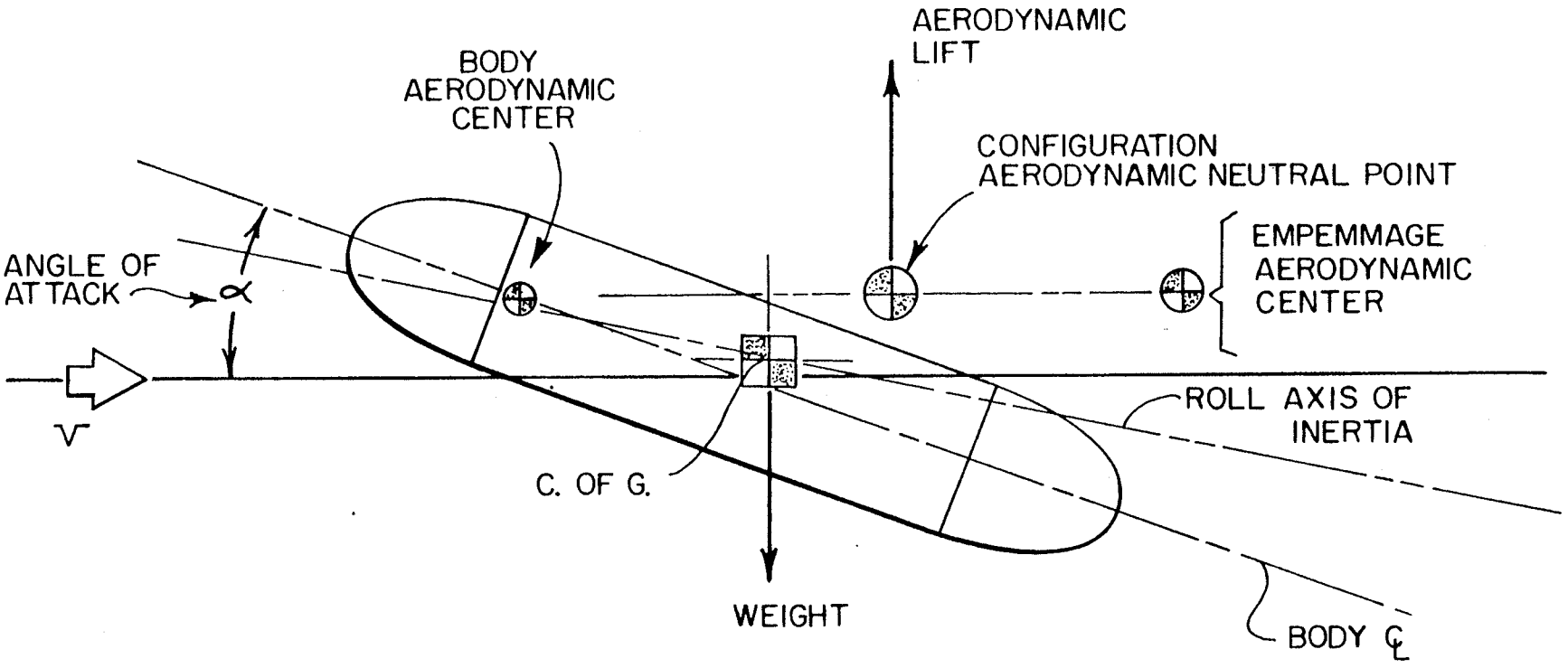
FIG. 2*a* is a schematic illustration of a ballistic body indicating its aerodynamic center and the aerodynamic center of an empennage as employed with the present invention.
Figure 2B:
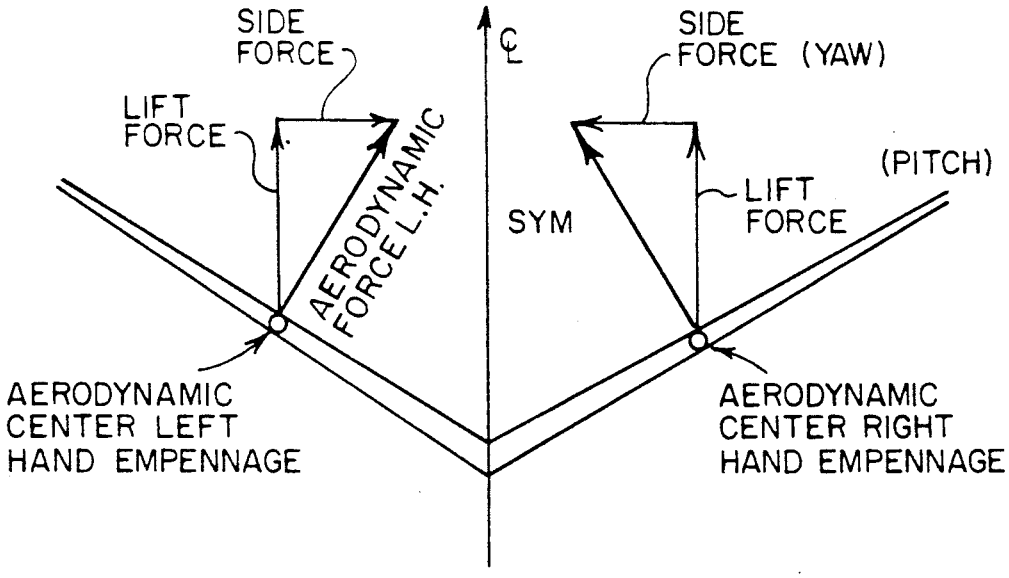
FIG. 2*b* is a schematic illustration of V tail empennages indicating the forces at the aerodynamic centers thereof.
Figure 2C:
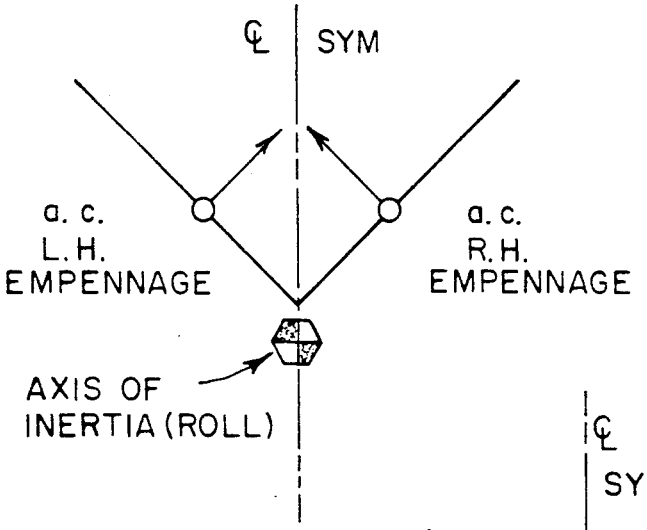
FIG. 2*c* is a schematic illustration of the V tail indicating the aerodynamic forces incident to an axis of inertia.
Figure 2D:
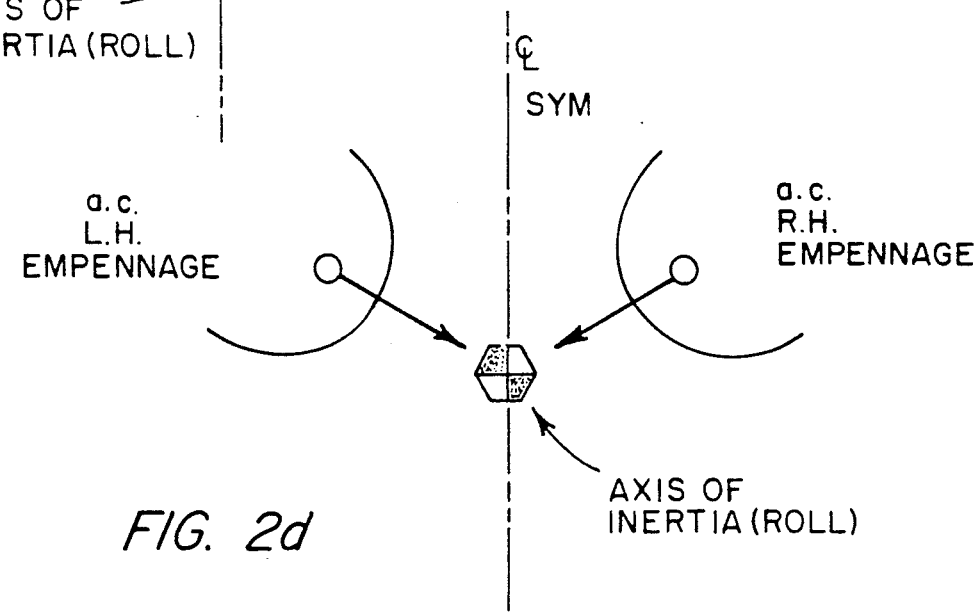
FIG. 2*d* is a schematic illustration of a "V" tail having stabilizer planforms matching cylindrical body contours resulting in a reversal of resultant aerodynamic forces.

Very rough estimates which account for increases in vortex span beyond the geometric span due to the arcuate wing contour give maximum lift/drag ratios of five or better for a cylindrical body of the type illustrated in FIGS. 7*a*–7*c*. More importantly, drag levels below those of the example of FIG. 1 trimmed at lift/drag≈2 are also indicated. Then, trade-offs between vertical separation and longitudinal separation can be made, e.g. to maximize decoy time within some desired radial distance from the aircraft.

Moments are mostly determined by the planform of the deployed surfaces, primarily the location of the break point and the planform of the forward surface since maximum available width at the trailing edge is usually desirable, as well as any extension over the radome area if possible.

The inclination of the hinge determines the camber of the deployed surfaces. A gentle longitudinal variation is generally desirable to minimize drag. A break point at mid-body length and quasi-symmetrical hinge inclinations would be ideally desired (or even three hinges to further smooth out the camber line), but this would restrict total deployed area. Locating the break point to some extent forward of the mid-body station should be favorable.

Figure 7D:
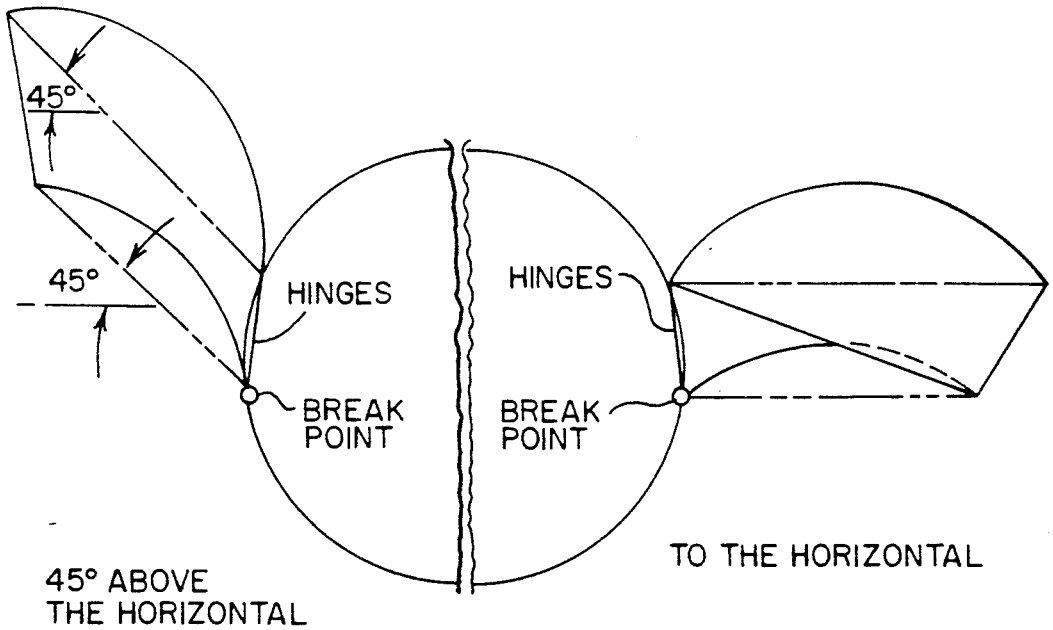

Deployment angle is also an important parameter. FIG. 7*d* illustrates deployment angles to the horizontal and to 45° above the horizontal. Although a loss in span (and lift/drag ratio) is evident for 45°, this raises the aerodynamic center well above the center of gravity and provides more directional stability than the 0° deployment angle. Edge loadings due to vortex lift should also be higher and increase both rolling moment slopes and roll damping moments.

This layout meets the desired criteria, except for the induced rolling moments due to yaw resulting from upward (and inboard) orientation of the aerodynamic forces well above the roll inertia axis. To reverse the curvature, the surfaces would have to be deployed downward, opening a gap and the desired deployment angles would be small, restricting deployed spans, away from optimum aerodynamic solutions.

To avoid this gap, a single linear hinge, set at positive angle of incidence with respect to the body center line can also be designed. With wing elements extending most of the bodylength and at a substantial angle of incidence needed due to large body $C_{Do}$ ($i \approx 10° \pm 3°$), volume losses become substantial, maximum span is affected (hinge point low at the rear) and wing area will further be reduced (delta wing apex moved back on the body or straked planform with less area than the full delta wing) to get satisfactory stability levels.

While far from the aerodynamic ultimate, these single hinge planforms still offer a manyfold improvement in decoy useful flight time over than of ballistic decoys, roughly a factor of about ten.

All these "winged" configurations pre-empt very large and very specific body skin areas which may not be compatible with packaging requirements. Good designs will purposefully include a variety of features often forgotten or ignored, e.g. captivated battery moved forward at ejection to increase stability margins, purposeful tilting of the roll inertia axis to minimize induced roll, rather than the pedestrian and non-controversial "symmetry," increased aerodynamic stability margins, particularly at high angles of attack, and at low angles of attack directional stability margins and stiffness again to minimize induced roll problems, etc.

Deployment of the wing element(s) could include spring-loaded hinges to insure positive deployment and dampers to minimize dynamic opening shockloads or equivalent means, well within the state of the art.

Development and production costs of the aerodynamic stabilizers and wing elements proposed here will probably be more than the air frame costs of the elementary or crude means currently in use, but still a very small percentage of the decoy costs with very expensive electronic elements. Their cost effectiveness in increased useful decoy flight times and trade-offs flexibility are obviously attractive.

It should be understood that the invention is not limited to the exact details of construction shown and described herein for obvious modifications will occur to persons skilled in the art.

I claim:

1. An aerobody which becomes fixedly oriented after ejection at a random orientation, the aerobody comprising:

at least one empennage having a continuous surface; and means for rotating the empennage, about an axis perpendicular to an axis of symmetry of the aerobody, to a deployed position from a stowed position flush with the surface of the aerobody, the deployed empennage positioned at a preselected angle relative to the aerobody axis, to a neutral point above and behind the body's center of gravity for imparting a positive lift/drag ratio to the aerobody;

wherein strongly cross-coupled pitch and yaw forces and moments are generated along with a positive dihedral effect for stabilizing the configuration.

2. The aerobody set forth in claim 1 wherein the empennage has a non-planar planform surface for directing resulting empennage aerodynamic forces toward a roll axis of inertia to minimize induced aerodynamic rolling moments and inertial cross couplings.

3. An aerobody which becomes fixedly oriented after ejection at a random orientation, the aerobody comprising:

at least one empennage having a continuous surface; and means for rotating the empennage, about an axis perpendicular to an axis of symmetry of the aerobody, to a deployed position from a stowed position flush with the surface of the aerobody, the deployed empennage positioned at a preselected angle relative to the aerobody axis, to a neutral point above and behind the body's center of gravity for imparting a positive lift/drag ratio to the aerobody;

wherein strongly cross-coupled pitch and yaw forces and moments are generated along with a positive dihedral effect for stabilizing the configuration;

wherein the empennage has a non-planar planform surface for directing resultant empennage aerodynamic forces toward a roll axis of inertia to minimize induced aerodynamic rolling moments inertial cross couplings;

and further wherein the empennage is mounted at the end of a pivotally mounted arm disposed at an obtuse angle relative to an axis of symmetry of the aerobody.

4. An aerobody which becomes fixedly oriented after ejection at a random orientation, the aerobody comprising:

at least one empennage having a continuous surface; and means for rotating the empennage, about an axis perpendicular to an axis of symmetry of the aerobody, to a deployed position from a stowed position flush with the surface of the aerobody, the deployed empennage positioned at a preselected angle relative to the aerobody axis, to a neutral point above and behind the body's center of gravity for imparting a positive lift/drag ratio to the aerobody;

wherein strongly cross-coupled pitch and yaw forces and moments are generated along with a positive dihedral effect for stabilizing the configuration;

wherein the empennage has a non-planar planform surface for directing resultant empennage aerodynamic forces toward a roll axis inertia to minimize aerodynamic rolling moments and inertial cross couplings; and wherein the empennage is mounted at the end of a pivotally mounted arm disposed at an obtuse angle relative to the aerobody axis of symmetry, the arm being connected to a hinge axis skewed relative to the axis of symmetry.

5. The aerobody set forth in claim 3 together with means for moving the arm about an axis of rotation for optimizing trimmed lift/drag ratio.

6. An aerobody which becomes fixedly oriented after ejection at a random orientation, the aerobody comprising:

at least one empennage having a continuous surface; and means for rotating the empennage, about an axis perpendicular to an axis of symmetry of the aerobody, to a deployed position from a stowed position flush with the surface of the aerobody, the deployed empennage positioned at a preselected angle relative to the aerobody axis, to a neutral point above and behind the body's center of gravity for imparting a positive lift/drag ratio to the aerobody;

wherein strongly cross-coupled pitch and yaw forces and moments are generated along with a positive dihedral effect for stabilizing the configurations;

wherein the empennage has a non-planar planform surface for directing resultant empennage aerodynamic forces toward a roll axis of inertia to minimize induced aerodynamic rolling moments and inertial cross couplings;

control surfaces; and wherein the aerobody further includes means for deploying the control surfaces to stabilize the body and trim the configuration at increased lift levels which increase trimmed lift/drag ratio.

7. The aerobody set forth in claim 3 wherein the at least one empennage comprises a plurality of planform surfaces deployed along separate hinge lines, the planform surfaces imparting a camber to additional control surfaces, generating nose up moments which improve the trimmed lift/drag ratio.

8. The aerobody set forth in claim 3 wherein the at least one empennage comprises a plurality of planform surfaces deployed to locate their centers of pressure well above the center of gravity to provide rolling moments favorable for decoy roll orientation and flight stability.

9. The aerobody set forth in claim 6 wherein the control surfaces are strakes symmetrically extending from the aerobody which improve body lift and configuration lift/drag ratio to eliminate empennage negative lift.

* * * * *

UNITED STATES PATENT AND TRADEMARK OFFICE

CERTIFICATE OF CORRECTION

PATENT NO. : 5,169,095

DATED : December 8, 1992

INVENTOR(S) : Robert J. Lecat

It is certified that error appears in the above-identified patent and that said Letters Patent is hereby corrected as shown below:

Column 6, line 40, change "($\phi$=0)" to --($\phi=0^{o}$)--.

Column 11, line 9, change "resulting" to --resultant--.

Signed and Sealed this

Twenty-sixth Day of October, 1993

*Attest:*

*Attesting Officer*

BRUCE LEHMAN

*Commissioner of Patents and Trademarks*